US007510395B2

(12) United States Patent
Hanno

(10) Patent No.: US 7,510,395 B2
(45) Date of Patent: Mar. 31, 2009

(54) DEVICE FOR INTRODUCING SUBSTANCES INTO REACTION SPACE

(75) Inventor: Tautz Hanno, Munich (DE)

(73) Assignee: Linde Aktiengesellschaft, Wiesbaden (DE)

( * ) Notice: Subject to any disclaimer, the term of this patent is extended or adjusted under 35 U.S.C. 154(b) by 224 days.

(21) Appl. No.: 11/471,729

(22) Filed: Jun. 21, 2006

(65) Prior Publication Data

US 2007/0077531 A1 Apr. 5, 2007

(30) Foreign Application Priority Data

Jun. 22, 2005 (DE) ..... 10 2005 029 317

(51) Int. Cl.
*F24D 14/62* (2006.01)

(52) U.S. Cl. ..... 431/353; 431/354; 431/355; 165/146; 138/111

(58) Field of Classification Search ..... 431/354, 431/355, 353; 165/146, 135; 138/111, 140, 138/146

See application file for complete search history.

(56) References Cited

U.S. PATENT DOCUMENTS 4,062,656 A * 12/1977 Blaser et al. ..... 48/73
4,518,567 A * 5/1985 Velling et al. ..... 422/143
4,676,744 A * 6/1987 Wray et al. ..... 432/181
5,226,980 A * 7/1993 Tsukuta et al. ..... 148/419
6,340,536 B1 * 1/2002 Noe et al. ..... 428/660

* cited by examiner

*Primary Examiner*—Alfred Basichas
(74) *Attorney, Agent, or Firm*—Millen, White, Zelano & Branigan, P.C.

(57) ABSTRACT

The invention relates to a device for mixing and/or introducing gases and/or liquids into a hot reaction space, said device comprising a metal tube and not being equipped with water cooling means. The metal tube is surrounded by a heat insulation made of refractory material to enable the device to be used even at high reaction space temperatures.

12 Claims, 1 Drawing Sheet

DEVICE FOR INTRODUCING SUBSTANCES INTO REACTION SPACE

The invention relates to a device for mixing and/or introducing gases and/or liquids into a hot reaction space, said device comprising at least one metal tube, the reaction space end of which is open, and which is connected to an apparatus providing a means for feeding the feed substances into the device.

One such device is for example a burner for firing a combustion chamber, said burner comprising a burner head comprising at least one outer metal tube and an inner tube arranged concentrically thereto. The inner tube serves, for example, for feeding an oxidizing agent while a combustible gas is passed through the annular passage formed between the two tubes. If air is used as the oxidizing agent, this usually provides for sufficient cooling of the burner head. However, when technically pure oxygen or oxygen enriched air is used for combustion or if the gases are fed into the burner head in a preheated form, then the end of the outer metal tube is often provided with a cooling channel which is supplied with cooling water through a cooling water coil externally welded thereto.

Water cooled burners have the disadvantage that, as a result of high temperature gradients between inner and outer side of the water cooled zone, high thermal stresses can occur in the material, which can lead to the formation of cracks and leaks. In addition, temperature zones are formed, in which a form of corrosion known as "metal dusting" takes place on typical high temperature steels in connection with a reducing reaction space atmosphere, thus leading to ablation and therefore destruction of the burner material. Moreover, soot is formed on the cooled burner head parts and, in certain cases, also on the cooling water coil.

It is therefore the object of the present invention to provide a device of the initially described type, which can be used for high reaction space temperatures even when it is not equipped with water cooling means.

Figure 1:
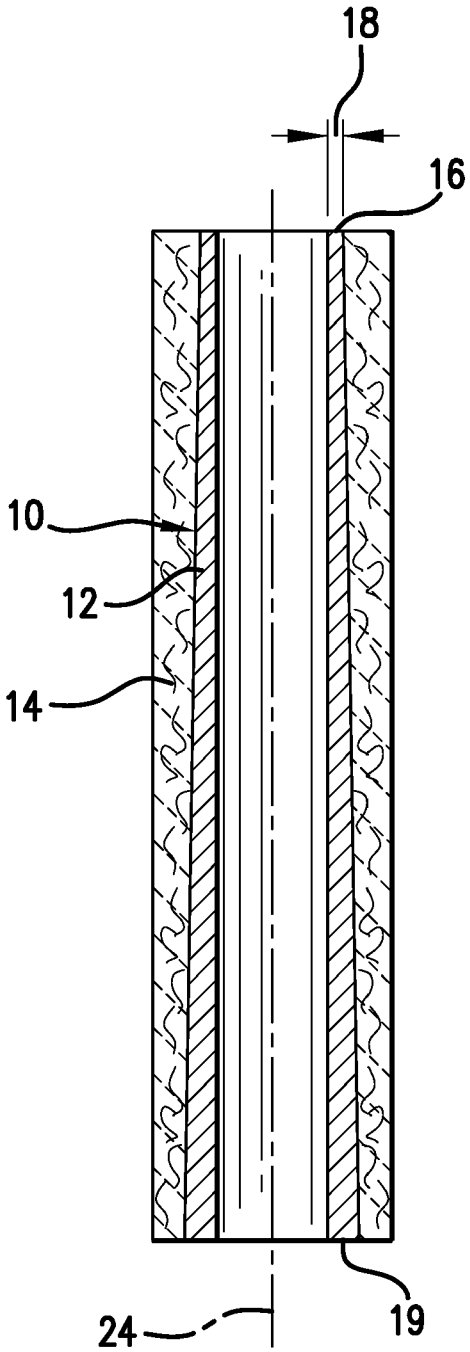
FIG. 1 is an elevational view of a metal tube configured in accordance with the present invention.
Figure 2:
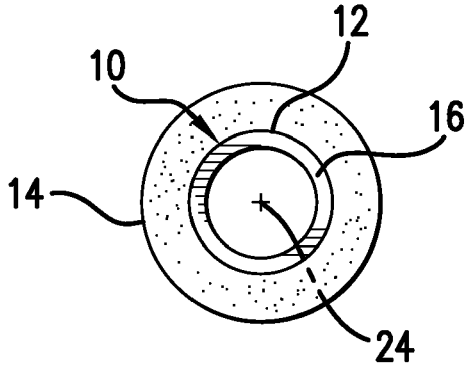
FIG. 2 is a view of an open reaction space end of the metal tube of FIG. 1.
Figure 3:
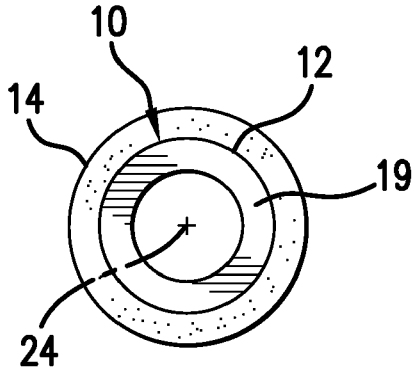
FIG. 3 is a view of a feed end of the metal tube of FIG. 1.

According to the present invention, and as seen in FIGS. 1-3 this object is achieved by surrounding the outer surface 10 of the metal tube 12 with a layer 14 of heat insulating refractory material 15 which extends along the longitudinal tube axis 14 starting from the metal tube end 16 on the side of the reaction space and by providing the metal tube end 16 on the side of the reaction space (the open reaction space end) with a wall thickness of between 0.1 and 3 mm.

The heat insulating refractory material 15 is preferably fitted in such way that it surrounds the metal tube 12 along its full length from a feed end 19 to the open reaction space end 16. The thickness of the heat insulating layer 14 is dimensioned so that damage of the metal tube 12 at the expected reaction space temperatures is reliably prevented.

According to the invention, the heat insulating refractory material 14 is a casting slip or ramming compound or a composite of heat resistant fibres. As well as a good heat insulating effect, the refractory material also presents a sufficiently high mechanical and chemical stability in order to endure the conditions existing during operation (gas oscillations, aggressive atmosphere in the reaction space).

According to the idea of the invention, the refractory heat insulation 14 does not project above the metal tube 12. This ensures that defined flow conditions exist at the metal tube end 16 on the side of the reaction space (the open reaction space end) even if parts of the refractory heat insulation come loose and surface defects are created. In order to keep the metal tube surface 10 directly exposed to the heat radiation small, said metal tube end 16 on the side of the reaction space is executed with a reduced wall thickness, which is a factor >10 smaller then the actual wall thickness of the metal tube 12. The tube wall thickness advantageously increases continuously in the upstream direction toward the feed end 19, thereby achieving a fast removal of the heat absorbed at the tube end and preventing an overheating thereof.

In a preferred embodiment of the device according to the invention, at least the metal tube 12 is made of a material offering sufficient protection against the corrosion form known as "metal dusting". According to a particularly preferred embodiment of the invention, at least the metal tube is manufactured of an oxide dispersion strengthened alloy, a so-called ODS material.

By means of the device according to the invention, feed substances having temperatures of between 100 and 700° C., preferably of between 200 and 600° C. and with pressures of between 1 and 100 bara, preferably of between 10 and 30 bara, may be introduced into a reaction space in which temperatures of up to 2000° C. exist. Examples of feed substances are hydrocarbons and/or air and/or oxygen enriched air and/or technically pure oxygen and/or steam and/or hydrogen and/or carbon dioxide and/or carbon monoxide. The invention is particularly suitable for introducing into a reaction space and combusting liquid or gaseous hydrocarbons and preferably hydrocarbons containing more than 80 vol % of methane, together with an oxidizing agent. The oxidizing agent, being air or oxygen enriched air or technically pure oxygen, is in this case introduced in such an amount that the combustion takes place at a fuel-air ratio of between 0.5 and 1.5.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 102005029317.4, filed Jun. 22, 2005 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. Device for mixing and introducing gases, liquids or mixtures of gases and liquids into a hot reaction space, said device comprising at least one metal tube having a longitudinal axis and having an open reaction space end, and a feed end, which feed end is connected to an apparatus providing a means for feeding feed substances into the metal tube, characterized in that the outer surface of the metal tube is surrounded by a layer of heat insulating refractory material which extends in the direction of the longitudinal axis of the metal tube from the open reaction space end of the metal tube end, the open reaction space end having a wall thickness in a range of 0.1 to 3 mm, the wall thickness at the open reaction space end having a reduced thickness that has decreased continuously from an actual wall thickness of the metal tube for fast heat removal of heat absorbed at the open reaction space end of the metal tube to prevent overheating thereof.

2. Device according to claim 1, characterized in that the heat insulating refractory material surrounds the metal tube along its full length.

3. Device according to claim 1, characterized in that the heat insulating refractory material is a casting slip or ramming compound or a composite of heat resistant fibres.

4. Device according to claim 1, characterized in that the metal tube is made of a material that protects against corrosion from metal dusting.

5. Device according to claim 1, characterized in that the metal tube is manufactured of an oxide dispersion strengthened alloy (ODS material).

6. Device according to claim 1, characterized in that the feed substances having temperatures of between 100 and 700° C. are introduced into the reaction space.

7. Device according to claim 1, characterized in that hydrocarbons or air or oxygen enriched air or technically pure oxygen or steam or hydrogen or carbon dioxide or carbon monoxide may be introduced into the reaction space as feed substances.

8. Device according to, characterized in that a feed substance containing more than 80 vol % of methane may be introduced into the reaction space.

9. Device according to claim 8, characterized in that an oxidizing agent may be introduced as feed substance into the reaction space, said oxidizing agent being air or oxygen enriched air or technically pure oxygen.

10. Device according to claim 1 characterized in that the feed substances having temperatures in the range of 200° C. and 600° C. are introduced into the reaction space.

11. Device according to claim 1 characterized in that the feed substances are selected from a group comprising hydrocarbons, air, oxygen enriched air, technically pure oxygen, steam, hydrogen, carbon dioxide and carbon monoxide.

12. Device according to claim 1 characterized in that the reduced thickness is smaller than the actual thickness of the tube by a factor greater than 10.

* * * * *